United States Patent [19]

Menasha

[11] Patent Number: 4,938,434

[45] Date of Patent: Jul. 3, 1990

[54] RESTRAINING MECHANISM

[75] Inventor: Samuel Menasha, Westford, Mass.

[73] Assignee: Raytheon Company, Lexington, Mass.

[21] Appl. No.: 387,564

[22] Filed: Jul. 31, 1989

[51] Int. Cl.[5] ..... F41G 7/26

[52] U.S. Cl. ..... 244/3.16

[58] Field of Search ..... 244/3.16

[56] References Cited

U.S. PATENT DOCUMENTS 2,963,973 12/1960 Estey ..... 244/3.16

4,155,521 5/1979 Evans et al. ..... 244/3.16

4,267,988 5/1981 Rodgers ..... 244/3.16

*Primary Examiner*—Charles T. Jordan

*Attorney, Agent, or Firm*—Edmund J. Walsh; Richard M. Sharkansky

[57] ABSTRACT

A restraining mechanism for a gimbal in a gyroscopically-stabilized seeker in a cannon-launched projectile is shown to consist of a movable latch, so shaped and disposed that relative longitudinal motion between the gimbal and the body of such projectile is prevented during the launching phase, and a release mechanism whereby the movable latch is cleared of the gimbal after the launching phase.

4 Claims, 3 Drawing Sheets

RESTRAINING MECHANISM

This invention was made with Government support under Contract No. DAAH01-87-C-1247 awarded by the Department of the Army.

BACKGROUND OF THE INVENTION

This invention pertains generally to guidance systems for cannon-launched projectiles, and particularly to mechanisms for protecting such a guidance system from the effects of high acceleration and deceleration during a launching phase.

It is known in the art that any guidance system intended to be used in a cannon-launched projectile must be capable of withstanding extremely large forces due to acceleration (and deceleration) experienced during the launching phase of such a projectile. For example, in the case of a projectile launched from a 155 millimeter cannon, an initial acceleration caused by firing results in a setback load in the order of 12,000 G (where G is the mass of the seeker) and then a deceleration (experienced when the projectile clears the barrel of the cannon) results in a setforward load in the order of 3000 G.

A so-called "strap-down" seeker presently is known to be a practical type of seeker capable of withstanding the setback and setforward loads experienced during the launching phase of a projectile fired from a cannon such as a 155 millimeter cannon. A "strap-down" seeker is characterized by the fact that the sensor in such a seeker is rigidly mounted within a projectile. As a result, a fixed field of view (relative to the centerline of the projectile) is provided. Consequently, unpredictable perturbations in the attitude of the projectile, i.e., coning due to precession or to nutation of the centerline of the projectile, cause the field of view similarly to change in an unpredictable manner. As a result, then, tracking of a desired target may become impossible.

SUMMARY OF THE INVENTION

With the foregoing background of this invention in mind, it is a primary object of this invention to provide a seeker for a cannon-launched projectile that is gyroscopically stabilized on gimbals within such projectile so that the field of view of the seeker may be changed as required with respect to the longitudinal centerline of such projectile.

Another object of this invention is to provide a simple but dependable mechanism to accomplish the primary object of this invention.

The foregoing and other objects of this invention are attained generally by providing a restraining mechanism having dogs formed integrally with the inner gimbal of a gyroscopically stabilized platform and a grooved latch, rotatably and slidably mounted on an inner surface of a cannon-launched projectile and coacting with the dogs so that: (a) the inner gimbal and any elements mounted on the inner gimbal are maintained in a substantially constant position along the longitudinal axis of the cannon-launched projectile prior to and during the firing cycle; and (b) the inner gimbal and any elements mounted on such gimbal are released after firing of the projectile by rotating the grooved latch out of contact with the dogs so that the inner gimbal may be gyroscopically stabilized during flight of the cannon-launched projectile after any loads due to setback or setforward load have been experienced.

BRIEF DESCRIPTION OF THE DRAWINGS

For a more complete understanding of this invention, reference is now made to the following description of the accompanying drawings wherein.

DESCRIPTION OF THE PREFERRED EMBODIMENT

Figure 1:
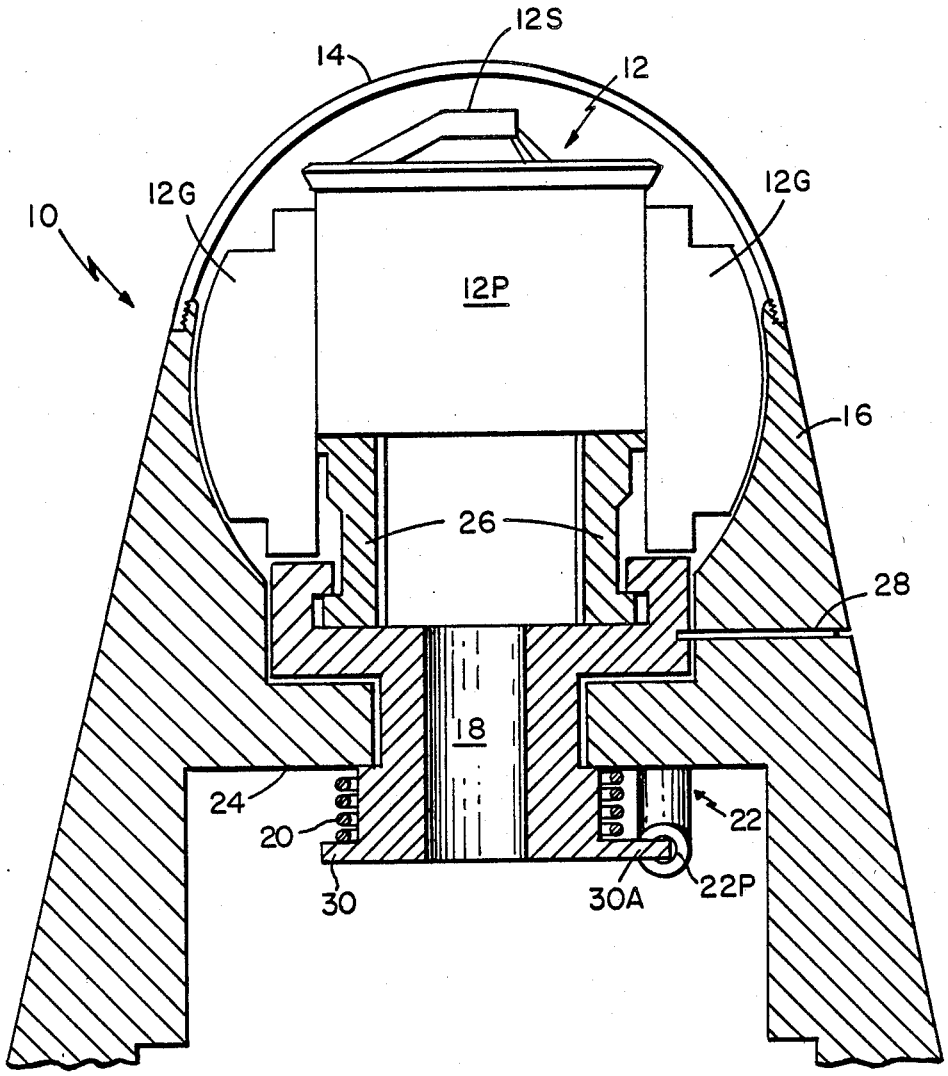
FIG. 1 is a simplified cross-section according to this invention of the nose section of a cannon-launched projectile wherein a gimbal of a gimballed seeker is shown to be latched into a position to withstand setback and setforward forces during the launching phase of such projectile.
Figure 2:
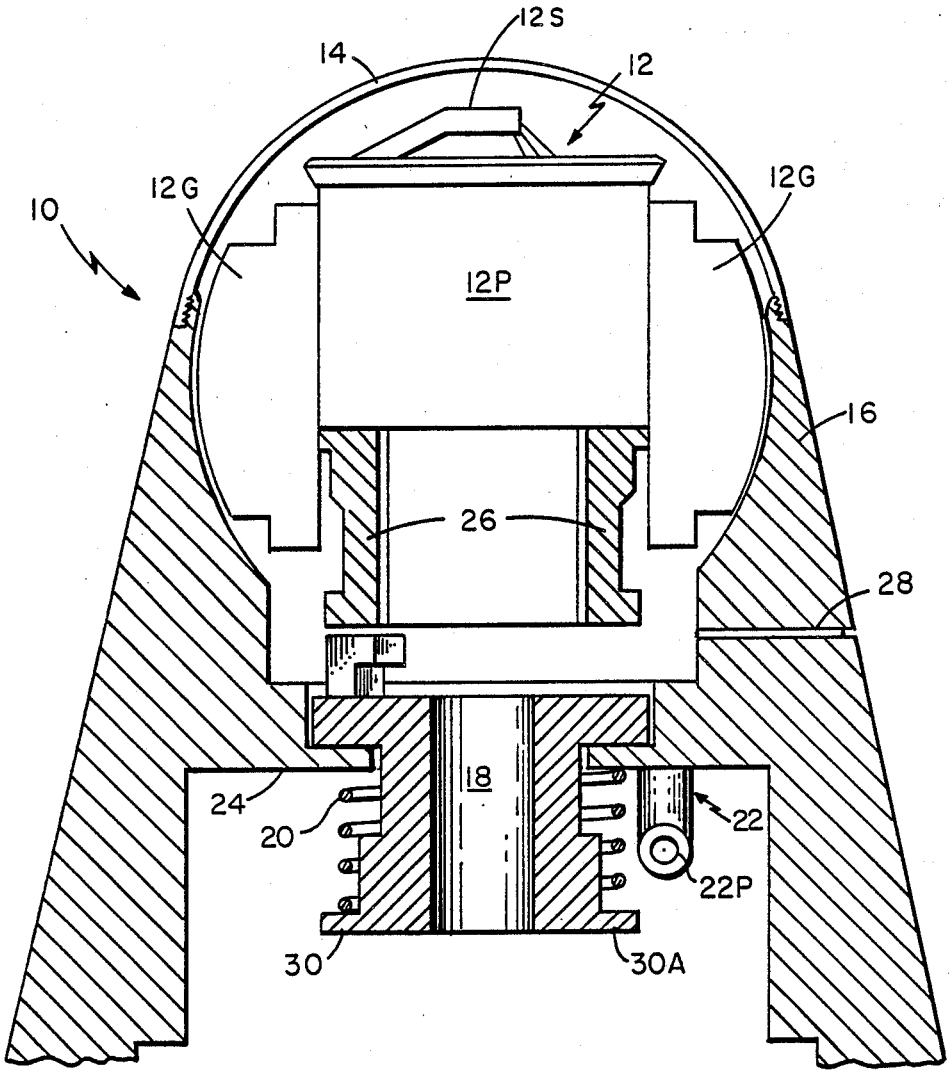
FIG. 2 is a simplified cross-section according to this invention of the forward end of a cannon-launched projectile after the launching phase of such projectile.

Referring now to FIGS. 1 and 2, it may be seen that the nose section 10 of a projectile (not numbered) is arranged so that a gimbal assembly 12 including a stabilized platform 12P and an infrared sensor 12S initially may be latched in place (see FIG. 1) with respect to the nose section 10 or later may be movably mounted (see FIG. 2) in such section.

Figure 3:
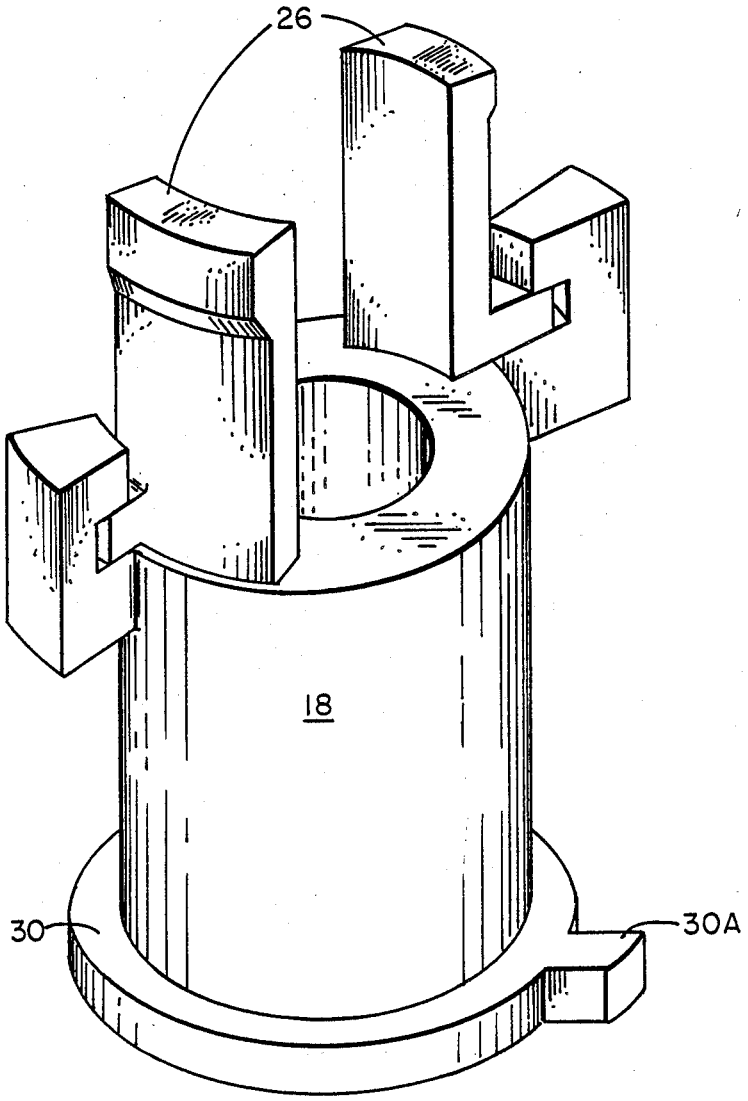
FIG. 3 is an isometric view of the restraining mechanism in a condition corresponding to that shown in FIG. 1, the isometric view of FIG. 3 further showing the way in which the transition to a condition corresponding to that shown in FIG. 2 may be effected according to a preferred embodiment of the invention.

It will be noted that the gimbal assembly 12 here illustrated shows the inner gimbals 12G of a two gimbal system. Thus, the outer gimbals of the two gimbal system (which outer gimbals are orthogonally disposed with respect to the inner gimbals 12G) are not visible in the crosssections of FIG. 1 and FIG. 2. It will be appreciated, however, by one of skill in the art that the outer gimbals coact with appropriate bearings (not shown) to position the two gimbal system within the nose section 10. The nose section 10 here is made up of a nose cone 14, here fabricated from a material such as sapphire, secured in any convenient manner to the forward end (not numbered) of the body 16 of the projectile. The inner portion of the forward end of the body 16 is shaped to provide: (1) a substantially spherical zone (not numbered) accommodating the facing surfaces of the gimbal assembly 12; (2) a first cylindrical section (not numbered) adjoining the substantially spherical zone to accommodate the facing surface of a latch 18; (3) a second cylindrical section (not numbered) counterbored with respect to the first cylindrical section to accommodate a spring 20 (sometimes referred to as a compression spring), the lower end of the latch 18 and an explosive squib assembly 22; and (4) a third cylindrical (but slotted as shown in FIG. 3) section interconnecting the first and second cylindrical sections as shown and serving as a journal bearing for the latch 18. A ledge 24 is formed inside the body 16 by appropriately sizing the first, second and third cylindrical sections and slotting the third cylindrical section as shown in FIG. 3. Projecting elements, referred to as gimbal standoffs 26, are attached, in any desired manner, to the bottom of the gimbal 12. To complete the assembly being described, a shear pin 28 is placed (as shown in FIG. 1) in an appropriate opening extending from the outside of the body 16 partially through the latch 18.

Referring now to FIG. 3, it may clearly be seen that dogs (not numbered) projecting outwardly from the free end of each one of the gimbal standoffs 26 initially mate (as shown in FIG. 1) with grooves (not numbered) formed in the latch 18. At the same time, contact is made between the lower surface of the grooved section of the latch 18 and the facing upper surfaces of the ledge 24. The spring 20 (FIG. 1) then is fully compressed between the lower surface of the ledge 24 (FIG. 1) and a flange 30 (FIG. 1) at the lower end of the latch 18. The shear pin (FIG. 1) then prevents any rotational motion of the latch 18 (and the engaged gimbal standoffs 26 and gimbal 12) relative to the body 16. When setback forces are applied to the gimbal 12 (and the gimbal standoffs 26), such forces are passed through the latch 18 and the ledge 24 to the body 16, thereby preventing longitudinal movement of the gimbal standoff 26 and gimbal 12 relative to the body 16. When setforward forces are extant (immediately after the body 16 clears the cannon barrel (not shown)), such forces are passed, through the projection from the flange 30 between the ledge 24 and the flange 30, to the body 16. Consequently, any relative motion between the body 16 and the latch 18, the gimbal standoffs 26 and the gimbal 12 is prevented during the time in which setforward forces are extant.

After the cannon-launched projectile enters into a ballistic trajectory, i.e., after setforward forces cease for all intents and purposes, the explosive squib assembly 22 is actuated in any convenient manner (not shown). A piston 22P projecting from the explosive squib 22 then is pushed against the projection 30A, to rotate the latch 18 (breaking the shear pin 28) so that the initially contacting grooved portions of the latch 18 are cleared of the dogs (not numbered) on the lower ends of the gimbal standoff 26 and the latch 18 is rotated into alignment with the slots in the third cylindrical section in the body 16 (FIGS. 1 and 2). The spring 20 then may expand, thereby forcing the latch 18 away from the gimbal standoff 26 and the gimbal 12 into the position shown in FIG. 2. The gimbal 12 then may be stabilized in any convenient manner.

Having described a preferred embodiment of this invention, it will now be apparent that changes may be made without departing from the inventive concept in the art of cannon-launched projectiles, of positively latching the inner gimbal of a gyroscopically stabilized seeker in a fixed position relative to the body of such a projectile during a firing sequence. Thus, it is evident that the number and shape of the latching elements may be varied so long as provision is made for both setback and setforward forces. It is felt, therefore, that this invention should not be restricted to its disclosed embodiment, but rather should be limited only by the spirit and scope of the appended claims.

What is claimed is:

1. In a gyroscopically stabilized seeker for installation on gimbals in a cannon-launched projectile, a restraining mechanism to prevent relative motion of such seeker longitudinally of the body of such projectile during the firing phase of such projectile, such restraining mechanism comprising:

(a) latching means, initially interconnecting a gimbal for the gyroscopically stabilized seeker and the body of the cannon-launched projectile, to maintain, before and during the launching phase, the position of the gimbal for such seeker longitudinally of such body;

(b) means, actuated at the end of the launching phase, to unlatch the latching means thereby to allow relative motion between the gyroscopically stabilized seeker and the body of the cannon-launched projectile.

2. Restraining mechanism as in claim 1 wherein the latching means comprises:

(a) dogs affixed to the gimbal of the gyroscopically stabilized gimbal;

(b) projections formed on an inner surface of the body of the cannon-launched projectile, each one of such projections being aligned with a corresponding one of the dogs to form a gap between each corresponding projection and dog;

(c) an elongated element rotatably and slidably mounted within the body of such projectile, such element having an interrupted grooved end portion initially to capture each dog and to bridge the gap between the top of each projection and each dog; and (d) means, responsive after completion of launching, for rotating the elongated element out of contact with the dogs and the projections and for translating such element to a position within the body to clear the dogs and the projections.

3. The restraining mechanism as in claim 2 wherein the last-named means comprises:

(a) a flange formed adjacent to the end of the elongated element removed from the interrupted grooved end portion;

(b) a compression spring disposed around the elongated element, one end of the compression spring bearing on the top of the flange, the compression spring initially being fully compressed; and (c) means, actuated after the firing phase, for rotating the elongated element thereby to allow the compression spring to move the elongated element longitudinally of the body to clear the dogs.

4. The restraining mechanism as in claim 3 having, additionally, a shear pin initially interconnecting the elongated element and the body, such pin being broken as the elongated element starts rotation.

* * * * *